US009522294B1

(12) United States Patent
Kangatharalingam et al.

(10) Patent No.: US 9,522,294 B1
(45) Date of Patent: Dec. 20, 2016

(54) PORTABLE AND EFFECTIVE WRIST, ARM AND SHOULDER EXERCISE DEVICE

(71) Applicants: Nallathamby Kangatharalingam, Stillwater, OK (US); Nirmalakanthi Kangatharalingam, Stillwater, OK (US)

(72) Inventors: Nallathamby Kangatharalingam, Stillwater, OK (US); Nirmalakanthi Kangatharalingam, Stillwater, OK (US)

( * ) Notice: Subject to any disclaimer, the term of this patent is extended or adjusted under 35 U.S.C. 154(b) by 100 days.

(21) Appl. No.: 14/467,736

(22) Filed: Aug. 25, 2014

(51) Int. Cl.

| | |
|---|---|
| ***A63B 23/16*** | (2006.01) |
| ***A63B 21/06*** | (2006.01) |
| ***A63B 23/035*** | (2006.01) |
| ***A63B 23/14*** | (2006.01) |

(52) U.S. Cl.
CPC ..... *A63B 21/06* (2013.01); *A63B 23/03516* (2013.01); *A63B 23/14* (2013.01); *A63B 23/16* (2013.01)

(58) Field of Classification Search
CPC ..... A63B 23/16; A63B 23/14
See application file for complete search history.

(56) References Cited

U.S. PATENT DOCUMENTS

| | | | | |
|---|---|---|---|---|
| 2,475,656 A | | 7/1949 | John | |
| 3,982,755 A | | 9/1976 | Sarich | |
| 4,438,920 A | | 3/1984 | Veillette | |
| 4,645,203 A | | 2/1987 | Moss | |
| 4,811,944 A | | 3/1989 | Hoff | |
| 5,060,933 A | | 10/1991 | Cedro | |
| 5,312,309 A | * | 5/1994 | Fox | A63B 21/0004 482/120 |
| 5,582,563 A | | 12/1996 | Fan | |
| 5,827,157 A | | 10/1998 | Lee | |
| 5,967,949 A | * | 10/1999 | Davenport | A63B 21/153 482/108 |
| 6,099,437 A | * | 8/2000 | DeMers | A63B 21/153 482/46 |
| 6,234,934 B1 | | 5/2001 | Gorczyca | |
| 6,312,359 B1 | * | 11/2001 | Brundle | A63B 21/0605 482/46 |
| 7,029,423 B2 | * | 4/2006 | Lear, Jr. | A63B 21/06 482/40 |
| 7,361,124 B1 | | 4/2008 | Chung-Ting | |
| 7,753,827 B1 | * | 7/2010 | Emick | A63B 21/00181 482/44 |
| 8,083,656 B2 | * | 12/2011 | Suiter | A63B 21/0552 482/126 |
| 8,241,187 B2 | | 8/2012 | Moon | |

* cited by examiner

*Primary Examiner* — Loan H Thanh
*Assistant Examiner* — Rae Fischer

(57) ABSTRACT

One embodiment of a simple and portable wrist, arm and shoulder exercise device is structured with a hand cycling means. One elongated and flexible member of the embodiment coupled to the hand cycling means, carries a weight support member on the other end. The said weight support member accommodates weight disc loading/unloading, also allowing plurality of discs.

1 Claim, 3 Drawing Sheets

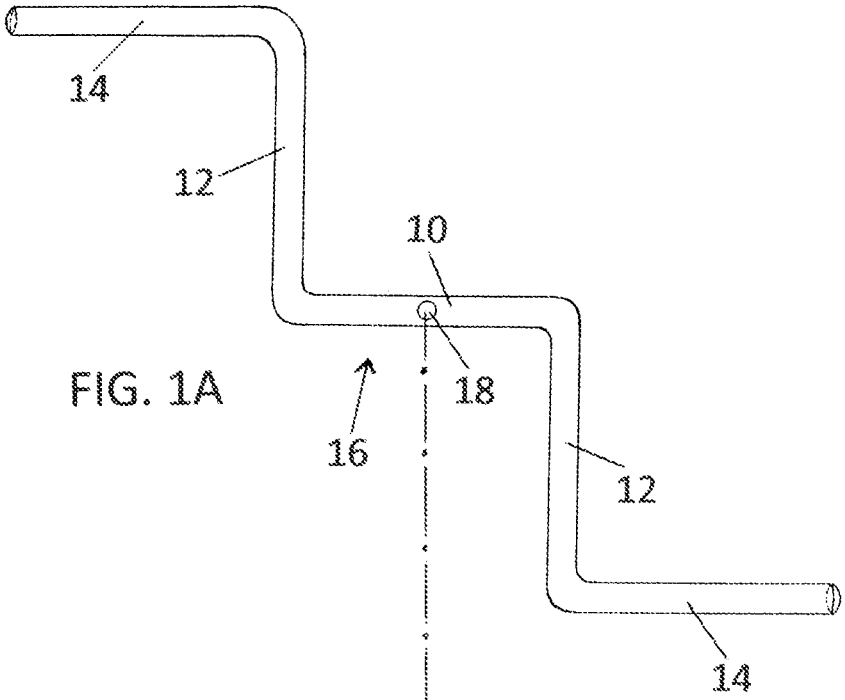
FIG. 1A
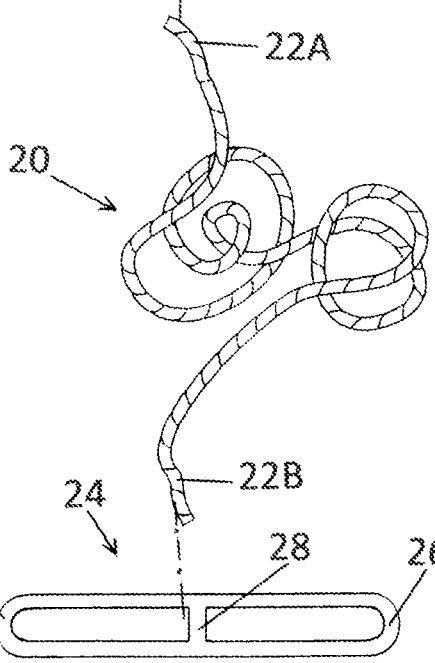
FIG. 1B
FIG. 1C

PORTABLE AND EFFECTIVE WRIST, ARM AND SHOULDER EXERCISE DEVICE

BACKGROUND

Prior Art

The following is a list of prior art that appears relevant to our application:

| Pat. No. | Kind code | U.S. patents issue date | Patentee(s) |
|---|---|---|---|
| 8,241,187 | B2 | 2012 Aug. 14 | Moon, Trulaske, Goldfader |
| 7,361,124 | B1 | 2008 Apr. 22 | Chung-Ting |
| 7,029,423 | B2 | 2006 Apr. 18 | Lear |
| 6,234,934 | B1 | 2001 May 22 | Gorczyca |
| 5,827,157 | A | 1998 Oct. 27 | Lee |
| 5,582,563 | A | 1996 Dec. 10 | Fan |
| 5,312,309 | A | 1994 May 17 | Fox |
| 5,060,933 | A | 1991 Oct. 29 | Cedro |
| 4,811,944 | A | 1989 Mar. 14 | Hoff |
| 4,645,203 | A | 1987 Feb. 24 | Moss |
| 4,438,920 | A | 1984 Mar. 27 | Veillette |
| 3,982,755 | A | 1976 Sep. 28 | Sarich |
| 2,475,656 | A | 1949 Jul. 12 | John |

Wrist, arm and shoulder exercises comprise a major part of general physical exercise routines. These three parts of human body are involved in activities that are carried out on a daily basis. Weakness in any of these parts directly affects the daily activities of a human body. Many different exercise devices have been designed for one or more of the above muscle groups. Some of the prior art devices are very complex while others are comparatively simple.

Lear invented a cord-winding exercise apparatus for wrist and forearm that requires mounting on a door frame, limiting its utility to indoor use only. Gorczyca invented a wrist and forearm exerciser where a straight handle holds a weight on a rope that is wound on the handle when the handle is rotated. This device though simple and handy has limited potential, being useful for only wrist and forearm. The wrist exerciser invented by Fox, and the wrist and hand exercisers invented by Veillette, and John have the fundamentals and limitations similar to the invention by Gorczyca, mostly useful for wrist and hand exercises.

The invention by Sarich uses a bottle as a weight source in an essentially similar device to exercise the wrist and hand. Moss invented a portable exercise device that claims to be a forearm exerciser and developer with limited use for exercising other parts of the body. The arm exerciser invented by Hoff is claimed to be useful in developing and strengthening wrist and arm muscles, and is designed to duplicate the activity of arm wrestling. Cedro invented a wrist and arm exercise device that has multiple components but is aimed at strengthening and exercising only the wrist and hand. The arm muscle exerciser invented by Lee, with a stand and handle design different from the above, provides the basic utility for exercising the wrist and arm muscles. The foregoing citations of prior art have many similar capabilities and uses. Even though they are mostly designed to be simple, they have the fundamental limitation that their applicability is for wrist, hand and/or arm exercises.

Simple and affordable exercise devices are preferred over complex and more expensive devices. The treadmill invented by Moon, Trulaske and Goldfader, the rowing machine invented by Chung-Ting, and the rowing exercise machine invented by Fan are much more complex and less affordable compared to the various foregoing prior art. Even though these complex exercise devices are meant for more than just the wrist, hand and the arm, their complexity, weight and affordability are considerable disadvantages. Simple but effective exercise devices designed to cover a wider range of muscle groups in the body while being affordable, portable and easy to use have definitive advantages and merits.

SUMMARY

The primary objective of the present invention is to provide a simple, easy to use, but effective and portable wrist, arm and shoulder exercise device that covers a wide range of muscle groups. According to one embodiment, our exercise device comprises a hand cycling crank, at the middle of which is attached a rope that is coupled to a means to carry a load at the other end.

In accordance with another embodiment the means on one end of the rope that carries the load allows adding, removing and switching loads. Another objective is to provide an exercise device that is economical and easy to manufacture.

ADVANTAGES

In accordance with the embodiments of one or more aspects, the advantages claimed herein are: a simple, easy to use, portable and effective exercise device for multiple muscle groups associated with the wrist, arm and shoulder. The device has the capability to strengthen and develop muscles, and in addition reduce excess body weight with prolonged daily use. The broad array of muscle groups this exerciser helps to strengthen and/or develop provides an advantage over prior art in its class. The present invention is designed to be a simple and effective device, that its manufacture is economical. Further features and advantages of one or more aspects will become apparent from the accompanying drawings and ensuing description.

DRAWINGS

Figures

In the accompanying drawings, closely related figures have the same number but different suffixes. The drawings are not necessarily to scale, and are only for the purpose of illustrating one or more embodiments of the present invention including their principles and are in no way limiting the invention. A brief description of the drawings is as follows:

FIGS. 1A to 1C show the major component parts namely the hand cycling crank (FIG. 1A), a sample rope (FIG. 1B), and the weight support member (FIG. 1C) of the exercise device and the manner in which they are assembled.

DRAWINGS

Reference Characters

Figure 2A:
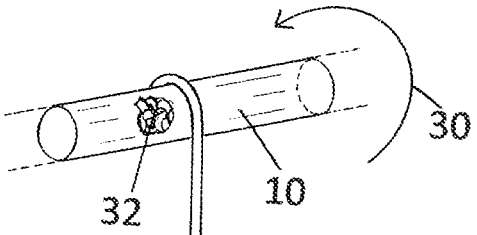
FIGS. 2A to 2B show the major component parts of the present invention after they are assembled (FIG. 2A). These figures also illustrate how to load a weight disc (FIG. 2B) to the device.

10 axle of the hand cycling crank
12 crank arm
14 crank handle

16 the hand cycling crank
18 axle hole for rope
20 a sample rope
22A upper end of rope
22B lower end of rope
24 weight support member
26 terminal part of weight support member
28 middle bar of weight support member
30 direction of axle rotation
32 knot that couples upper end of rope to the axle
34 taut rope in the assembled device
36 loop that couples the rope to the weight support member
38 tie down sleeve
40 protruding end of rope after tying down
42 weight disc
44 arrow showing how to load a weight disc
46 center aperture on weight disc
48 arrows showing hand cycling direction
50 wraps of rope around axle

DETAILED DESCRIPTION OF EMBODIMENTS OF THE INVENTION

Figure 2B:
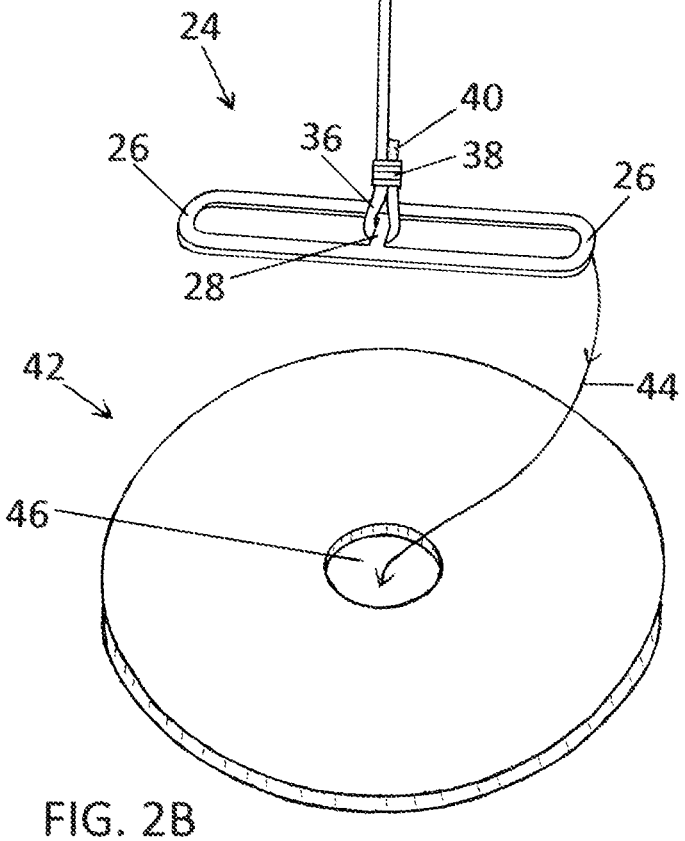
Figure 3:
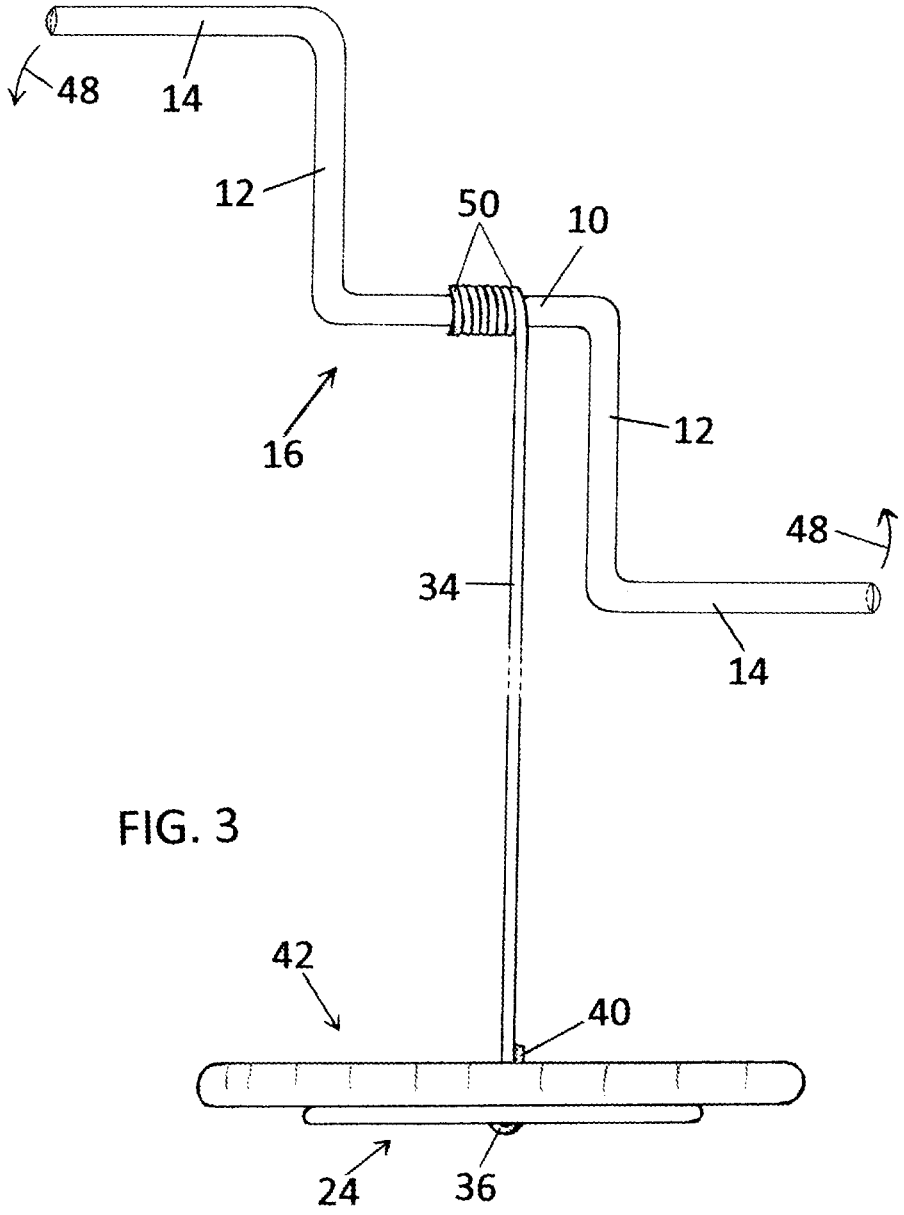
FIG. 3 shows the fully assembled exercise device as it is utilized.

As illustrated in FIGS. 1A-C the embodiments of our present invention comprise a portable exercise device made up primarily of a hand cycling crank 16, a rope 20 and a weight support member 24. The upper end 22A of rope 20 is inserted into the axle hole 18 of the hand cycling crank 16 (FIGS. 1A-B) to couple it by making thick and strong knot 32 at the terminal part of the rope (FIGS. 1A-B, 2A). The lower end 22B of the rope as shown in FIGS. 1B-C is mounted to the weight support member 24 by making a loop 36 around the middle bar 28. The loop 36 is tightly and securely tied using a metallic tie down sleeve 38 leaving a protruding end 40 out of the sleeve 38 as shown in FIG. 2A. The weight support member 24 is structured to position the middle bar 28 in the middle of its embodiment (FIGS. 1C, 2A). The weight support member 24 that hangs from the rope 34 is loaded with one or more weight discs 42 as needed for exercising, by inserting the terminal part 26 of the weight support member 24 and drawing it through the center aperture 46 as depicted in FIGS. 2A-B. Once loaded, weight disc 42 stays flat on the weight support member 24 and both hang from the attached rope 34 in a near horizontal plane as in FIG. 3. In the configuration depicted in FIGS. 1A, 3 the embodiment of the hand cycling crank 16 is preferably constructed of a non-corrosive, cylindrical, rigid material of sufficient strength and temper to withstand the stresses and strains in the purposes served. The rope 20, 34 used in the embodiments as in FIGS. 1B, 2A, 3 is selected for strength and durability. The embodiment of the weight support member 24 is preferably constructed of a metallic material that is non-corrosive and sufficiently strong (FIGS. 1C, 2A, 3).

The loaded embodiment of our present invention as in FIG. 3 is now assembled for use. The embodiment of the hand cycling crank 16 as in FIGS. 1A, 3 comprises a middle axle 10, two crank arms 12 one on either side at right angles to the axle 10 and parallel to each other, and two terminal handles 14 one on either side at right angles to the crank arms 12 and parallel to each other. In use, the two handles 14 of the loaded hand cycling crank 16 are grasped by both hands with the arms outstretched. The device is hand cycled as shown by arrows 48, keeping the axle 10 generally horizontal (FIG. 3). The said hand cycling causes the rope 34 which is coupled to the axle 10, to wind and form wraps 50 around the axle 10, thereby lifting the weight disc 42 that hangs from the taut rope 34. When the weight disc 42 moves up close to the handle 14, the hand cycling motion is briefly paused to reverse the cycling direction while continuing to keep the arms outstretched, thereby slowly bringing the weight disc 42 downwards and unwrapping the rope from the axle 10. This process is repeated as many times as desired with appropriate load.

In addition to exercising with horizontally outstretched arms, hand cycling can also be carried out with the arms outstretched at 30 or 45 degrees above or below horizontality. Such variations will engage a wider range of muscle groups in the arms and shoulders.

FURTHER ADVANTAGES

From the illustrations, descriptions and operational details provided herein, a number of advantages of some embodiments of our present invention become evident:

a) The portable wrist, arm and shoulder exercise device of our present invention, compared to many prior art of its class, engages a wider range of muscle groups and hence produces more effective results.
b) The simplicity, portability and the uniqueness of its embodiments afford our present invention a significant advantage.
c) Being simple in its structure and design makes the manufacture of our exercise device economical and affordable.
d) The preferred material used to fabricate embodiments of the present invention, selected for corrosion resistance, rigidity, strength and/or durability makes our present invention valuable and preferable.
e) The weight disc loading means, and the weight support member in our present invention are designed for quick loading/unloading, reliability and to maintain a flat surface under the weight disc after loading.
f) By increasing loads and hand cycling duration, our present invention can also be used as an exercise device to reduce one's waistline and body weight.
g) Utilizing the present invention with appropriate loads, repetition and duration can lend itself to serve as a rehabilitation tool.
h) The weight support member of our device is designed to accommodate standard as well as Olympic sized weight discs for loading, an added advantage.

SCOPE

Even though several embodiments of the present invention have been illustrated and described, it is recognized that other variations are possible in relation to features, components, material and configurations. Those skilled in the art will recognize that modifications, alterations, additions, and/or deletions may be made to the currently preferred embodiments without departing from the spirit and scope of the invention. Accordingly, the scope of the embodiments should be determined by the appended claims and their legal equivalents, rather than by the illustrations, descriptions and examples provided herein.

We claim:

1. A portable, hand-held exercise device, consisting essentially of:

a single unitary bar with generally uniform outer diameter, composed of rigid material and having:
a central portion with a central longitudinal axis and a through hole near the center of the bar;

two medial portions immediately adjacent to and on opposites sides of the central portion, each with a central longitudinal axis that is approximately perpendicular to the longitudinal axis of the central portion, wherein each medial portion extends from the central portion in an opposite direction from the other medial portion; and two end portions, each extending from one of the medial portions and having a central longitudinal axis that is approximately perpendicular to the longitudinal axis of the adjacent medial portion and approximately parallel to the longitudinal axis of the central portion, wherein each end portion extends from the respective medial portion in an opposite direction from the other end portion, and wherein the end portions form handles adapted for grasping by the hands of a user;

an elongate support member having:

two elongate rods, oriented in parallel to each other;

two end connectors, oriented generally perpendicularly to, between and at the ends of the elongate rods, wherein the end connectors are positioned at opposite ends of the elongate rods and curved, giving the exterior perimeter of the elongate support member a generally ovular or stadium shape;

a central connector, oriented between and perpendicular to the elongate rods, wherein the position of the central connector within the elongate support member generally bisects the interior space of the elongate support member defined by the two elongate rods and the two end connectors;

a single unitary length of rope; and one or more exercise weights, each having a central through hole configured for attachment of a supportive element;

wherein the through hole of the central portion of the single unitary bar is configured to allow passage of one end of the rope, such that the rope can be anchored to prevent the rope from slipping out of the through hole of the central portion;

wherein the elongate support member is configured to allow the single unitary length of rope to pass through a gap between the elongate rods and on either side of the central connector, such that the rope can be anchored to the elongate support member;

wherein the elongate support member is sized and configured to allow passage through the through hole of each of the one or more exercise weights, such that the elongate support member rests on one side of that exercise weight, the rope extends through the through hole of that exercise weight and the single unitary bar resides on the opposite side of that exercise weight;

wherein the surface of the elongate support member is generally flat and planar to provide a stable surface on which the one or more exercise weights can rest; and wherein the exercise device is configured to allow a user to grasp the two end portions and execute a cranking motion about the central portion to wind the rope about the central portion against the resistance afforded by the one or more exercise weights.

* * * * *